US008650731B2

(12) United States Patent
Ko

(10) Patent No.: US 8,650,731 B2
(45) Date of Patent: Feb. 18, 2014

(54) RIVET TOOL CAPABLE OF MEASURING SIZE OF BLIND RIVET

(75) Inventor: Philey Ko, Taipei Hsien (TW)

(73) Assignee: Karat Industrial Corporation, Taipei Hsien (TW)

( * ) Notice: Subject to any disclaimer, the term of this patent is extended or adjusted under 35 U.S.C. 154(b) by 436 days.

(21) Appl. No.: 12/885,579

(22) Filed: Sep. 20, 2010

(65) Prior Publication Data

US 2011/0209341 A1 Sep. 1, 2011

(30) Foreign Application Priority Data

Feb. 26, 2010 (TW) ..... 99203542 U

(51) Int. Cl.
*B21J 15/34* (2006.01)

(52) U.S. Cl.
USPC ..... 29/243.521; 72/391.8

(58) Field of Classification Search
USPC ..... 29/524.1, 525.06, 798, 29/243.542–243.528; 72/114, 391.8
See application file for complete search history.

(56) References Cited

U.S. PATENT DOCUMENTS 3,328,985 A * 7/1967 Keymer ..... 29/243.528
3,646,800 A * 3/1972 Martin ..... 29/243.528
3,842,649 A * 10/1974 Di Maio ..... 29/243.528
3,886,782 A * 6/1975 Miyamoto ..... 29/243.528
4,028,756 A * 6/1977 Couto ..... 7/107
4,347,729 A * 9/1982 Mitani ..... 29/243.528
4,353,239 A * 10/1982 Fujimoto ..... 29/243.528
4,807,460 A * 2/1989 Tzong ..... 29/243.528
4,864,839 A * 9/1989 Schwab ..... 72/391.2
5,361,474 A * 11/1994 Yang ..... 29/243.528
5,437,085 A * 8/1995 Liu ..... 29/243.521
5,651,169 A * 7/1997 Ohuchi et al. ..... 29/243.525
6,115,900 A * 9/2000 Cerulo et al. ..... 29/243.521
6,702,530 B2 * 3/2004 Bennage et al. ..... 408/241 R
7,043,826 B2 * 5/2006 Naito ..... 29/798
7,591,616 B1 * 9/2009 Kerner ..... 408/124
2001/0054221 A1 * 12/2001 Ohuchi ..... 29/243.521
2006/0005315 A1 * 1/2006 Konen ..... 7/107
2006/0075857 A1 * 4/2006 Kuo ..... 81/490
2006/0101582 A1 * 5/2006 McCreesh ..... 7/164
2006/0179649 A1 * 8/2006 Bouman et al. ..... 29/798
2009/0090225 A1 * 4/2009 Nenadic ..... 81/440

* cited by examiner

*Primary Examiner* — Minh Trinh
(74) *Attorney, Agent, or Firm* — Pai Patent & Trademark Law Firm; Chao-Chang David Pai

(57) ABSTRACT

A rivet tool capable of measuring size of blind rivet has a body and multiple interchangeable nosepieces. The body further has multiple rivet body measuring holes formed through the body. Diameters of the rivet body measuring holes match rivet bodies of corresponding blind rivets. Accordingly, the rivet tool of the present invention employs the rivet body measuring holes to measure a size of a rivet body of a blind rivet to rapidly, conveniently and correctly obtain a size of a rivet body of a blind rivet and further to correctly choose a nosepiece with a matching size.

9 Claims, 12 Drawing Sheets

RIVET TOOL CAPABLE OF MEASURING SIZE OF BLIND RIVET

BACKGROUND OF THE INVENTION

1. Field of the Invention

The present invention is related to a rivet tool, and more particularly to a rivet tool capable of measuring size of blind rivet.

2. Description of the Related Art

Blind rivets are used to fasten workpieces with a rivet tool. The advantage of using the blind rivets to fasten workpieces is that a user can operate the rivet tool at one side of the workpieces to be fastened without having to see or access the other side of the workpieces.

A blind rivet has a rivet body and a mandrel. The demarcate sizes of regular blind rivets are determined by sizes of the rivet bodies instead of those of the mandrels. The sizes of the rivet bodies are 3/32" (2.4 mm), 1/8" (3.2 mm), 5/32" (4.0 mm), 3/16" (4.8 mm) and 1/4" (6.4 mm) according to specifications of American Industrial Fasteners Institute (IFI), while the sizes of the rivet bodies are 2.4 mm, 3.0 mm, 3.2 mm, 4.0 mm, 4.8 mm, 5.0 mm, 6.0 mm and 6.4 mm according to International Organization for Standardization (ISO).

In collaboration with the use of blind rivets, rivet tool is an indispensable tool for fastening blind rivets on workpieces. Usually, the mandrel is inserted into a working nosepiece of the rivet tool and the rivet body is inserted into the prepared hole of workpieces. The rivet tool grips and pulls the shank of the mandrel to draw the rivet body, so that the rivet body is compressed and expanded to fasten on the workpieces. The mandrel is snapped off and the rivet body is tightly fastened the workpieces in the end.

When blind rivets are shipped out of factories, rivet bodies having identical size are packed in a same package and marked with the sizes of the rivet bodies. Matching blind rivets and nosepieces must be identified before a rivet tool can correctly and smoothly draw the blind rivets. However, as blind rivets are not marked with size thereon, the unpacked and mixed blind rivets with various sizes could cause trouble in identifying matching blind rivets to use unless users are experienced and familiar with the related field.

If users fail to identify matching blind rivets and nosepieces to use, blind rivets would fail to be correctly drawn and fastened. For example, if the size of a rivet body is 4.0 mm (the diameter of the matching mandrel is less than 2.41 mm) and the mandrel for the 4.0 mm rivet body is inserted into a working nosepiece corresponding to the mandrel for a 3.2 mm rivet body (the maximum inner diameter could be 2.41 mm and up), the mandrel of the 4.0 mm blind rivet may still remain inserted into the working nosepiece for the 3.2 mm rivet body, while the broken mandrel could be jammed in the working nosepiece of the rivet tool without being able to be ejected. On the contrary, if a size of a rivet body is 4.0 mm and the mandrel for the 4.0 mm rivet body is inserted into a working nosepiece matching for the mandrel corresponding to a 4.8 mm rivet body, the mandrel may not be easily gripped and fast snapped off, thereby failing to successfully break the mandrel and expedite the fixing job of workpieces.

Accordingly, once the sizes of blind rivets and working nosepieces are not matching, the blind rivets not only cannot be rapidly drawn and fastened, but also many blind rivets are wasted or rivet tools need to be repaired for being jammed by the broken mandrel. Due to unmarked specification on blind rivets, except through related professional craftsmen, the problem that users cannot directly and promptly pick right blind rivets to use needs to be refined.

SUMMARY OF THE INVENTION

An objective of the present invention is to provide a rivet tool capable of measuring size of blind rivet.

To achieve the foregoing objective, the rivet tool has a body and multiple nosepieces.

The body has multiple rivet body measuring holes formed therein. Each of the rivet body measuring holes has a diameter adapted to match a rivet body of a corresponding blind rivet.

The nosepieces are interchangeably mounted on the body.

The size of the blind rivet to be used can be rapidly determined by directly inserting the rivet body of the blind rivet into the rivet body measuring holes. Once the size of the rivet body is determined, the corresponding nosepiece can correctly picked up to mount into the working nosepiece position for operation. Given the rivet body measuring holes for measuring sizes of rivet bodies of blind rivets and the nosepieces, the whole operation of the rivet tool is efficient and convenient without having a chance to mistakenly insert an incorrect blind rivet into the rivet tool and possibly broken mandrel jammed in the rivet tool.

DETAILED DESCRIPTION OF THE INVENTION

Figure 1:
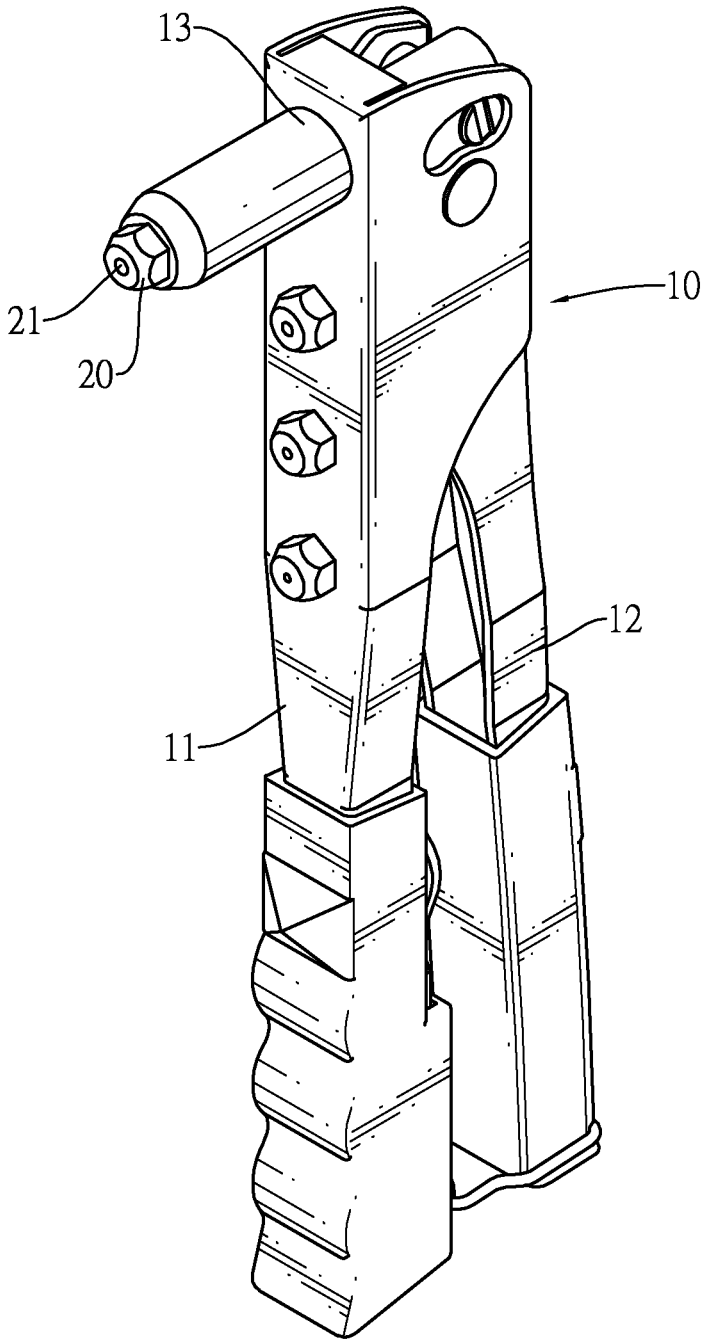
FIG. 1 is a perspective view of a first embodiment of a rivet tool capable of measuring size of blind rivet in accordance with the present invention.
Figure 2:
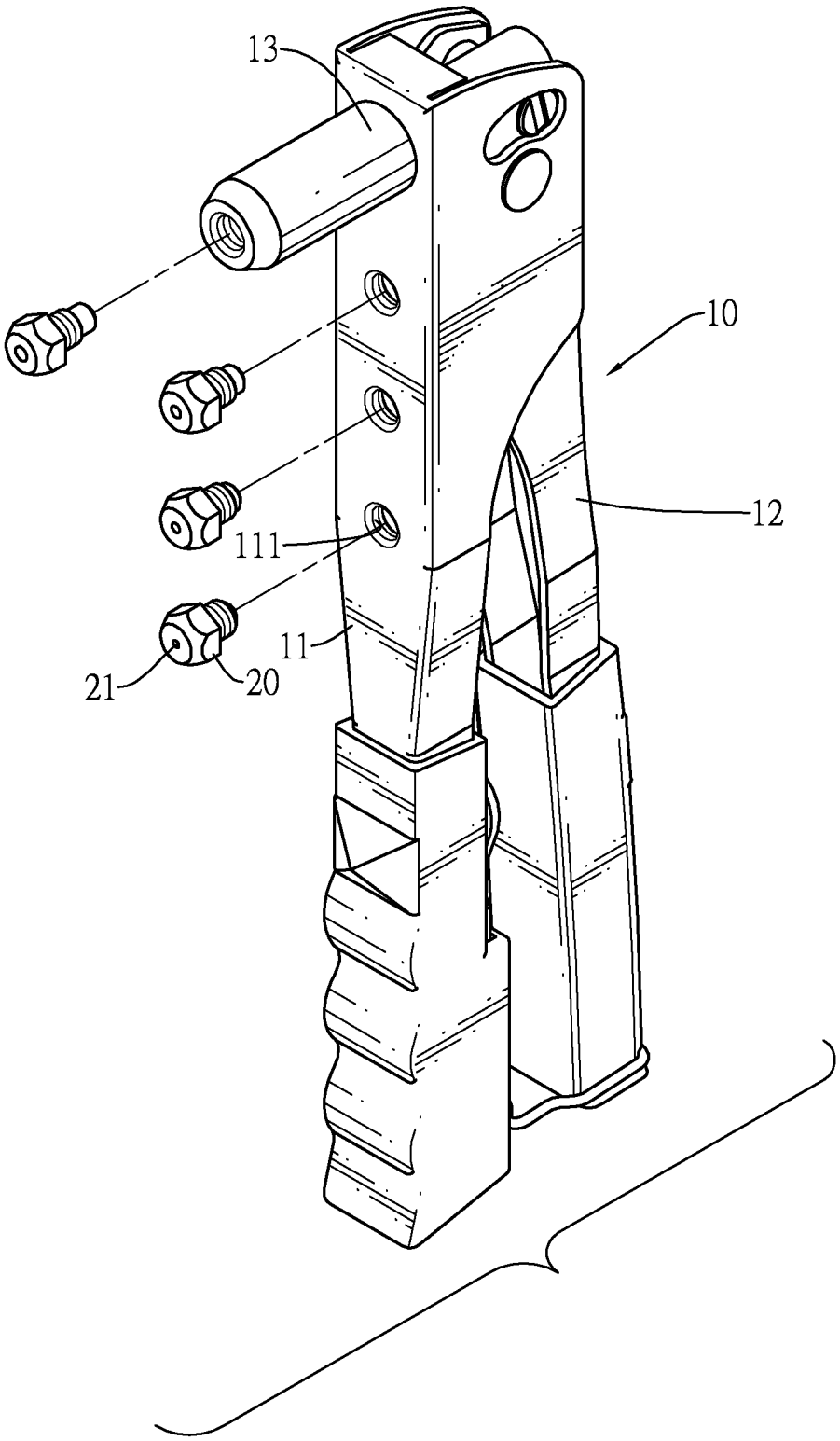
FIG. 2 is a partially exploded view of the rivet tool in FIG. 1.
Figure 3:
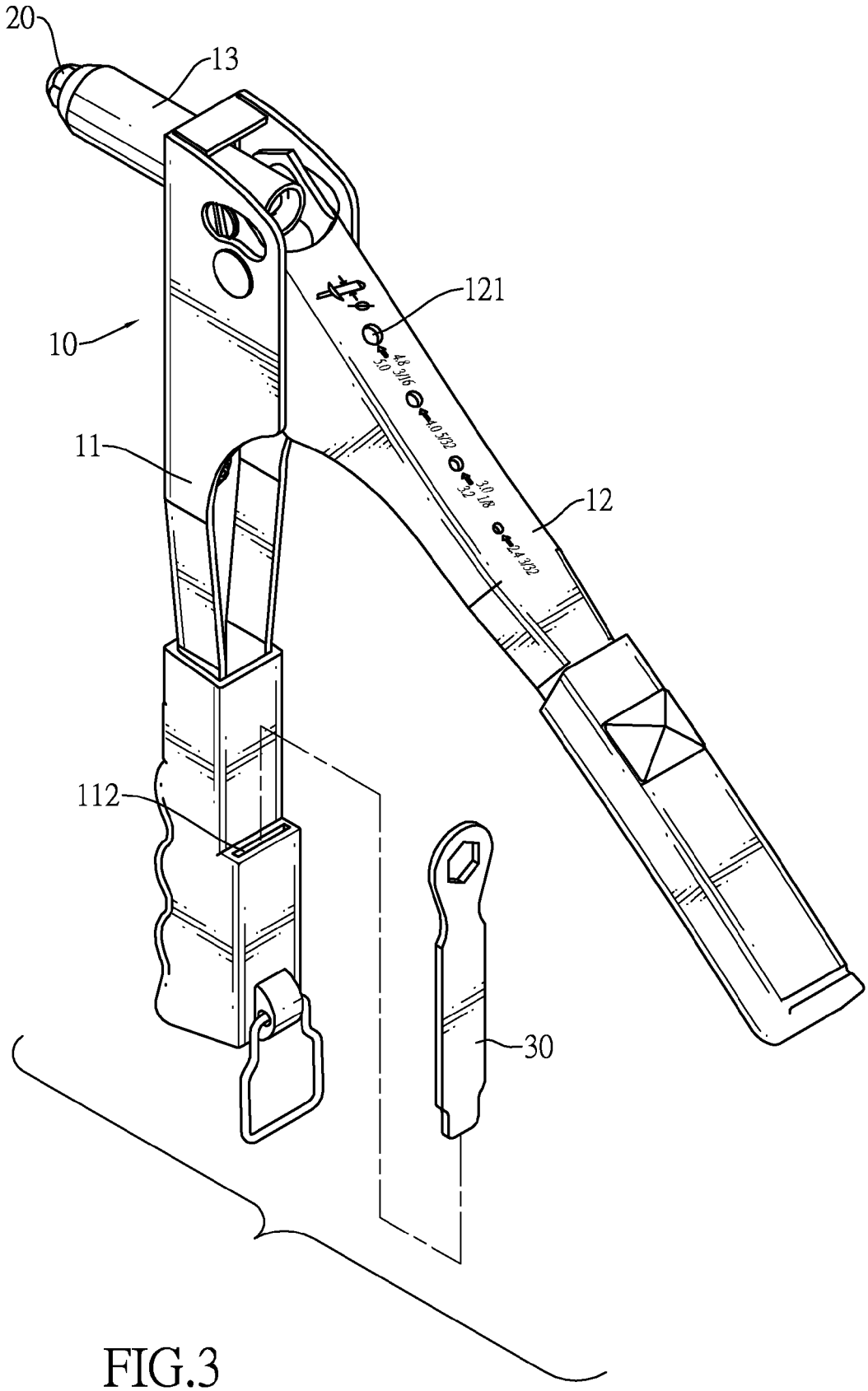
FIG. 3 is another partially exploded view of the rivet tool in FIG. 1.

With reference to FIGS. 1 to 3, a hand-gripped rivet tool has a body 10, multiple nosepieces 20 and a wrench 30.

The body 10 has a fixed handle 11, an actuation handle 12 and a pulling unit 13. The fixed handle 11 has a first end, multiple nosepiece fixing holes 111 and a storage slot 112. The nosepiece fixing holes 111 are formed through an outer wall of the fixed handle 11. The storage slot 112 is formed in another outer wall of the fixed handle 11.

Figure 4:
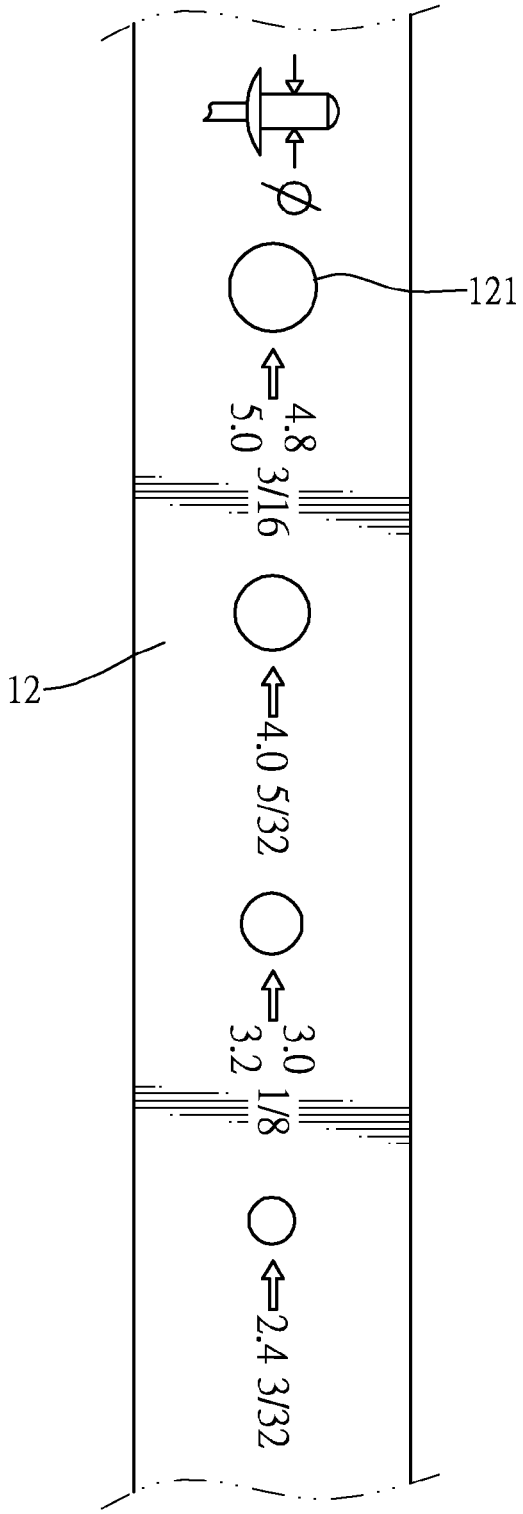
FIG. 4 is a schematic view of an actuation handle of the rivet tool in FIG. 1 having size specifications of rivet bodies of blind rivets.
Figure 5:
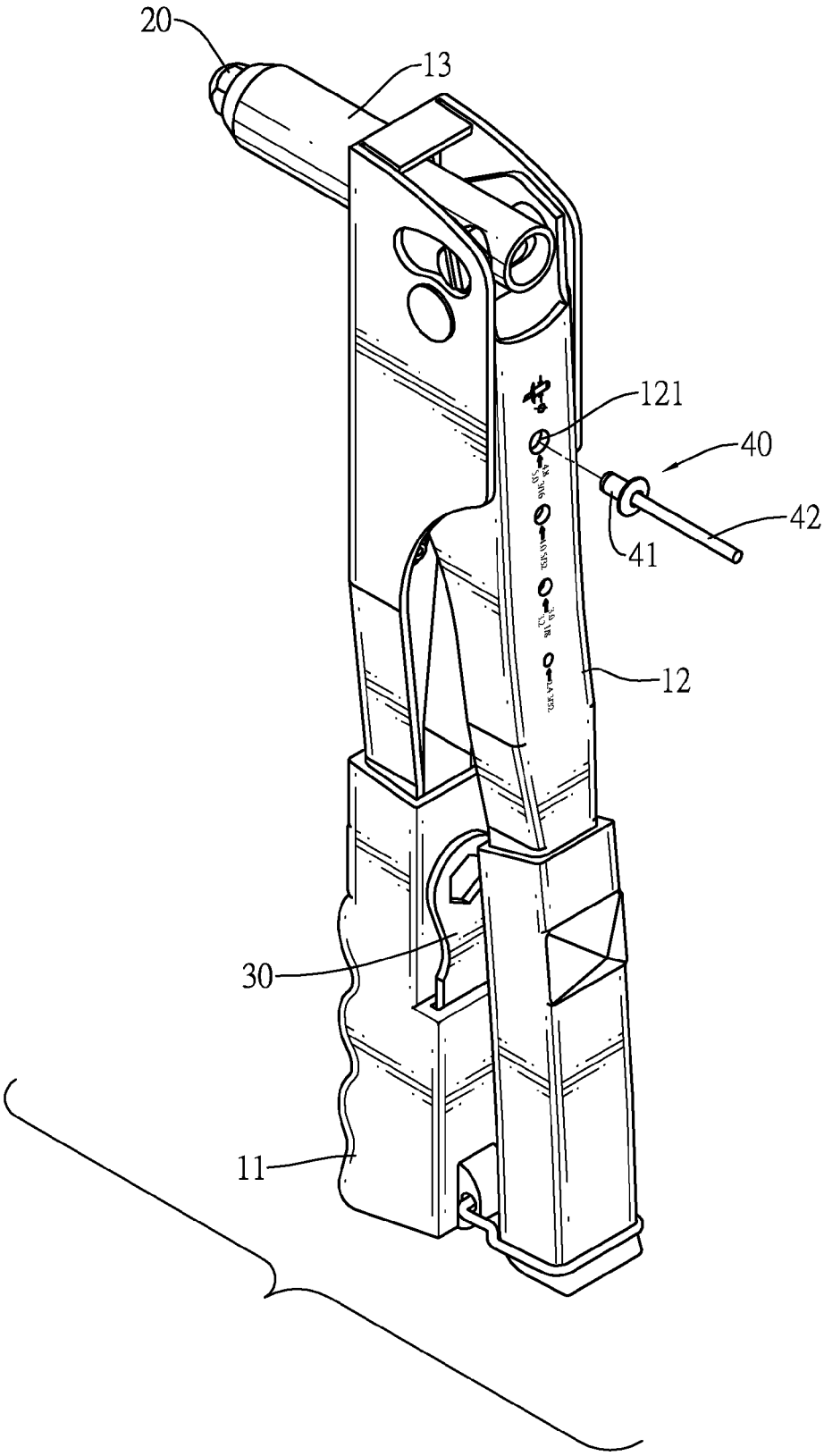
FIG. 5 is an operational prospective view showing a blind rivet inserted into a rivet body measuring hole on the actuation handle in FIG. 4.
Figure 6:
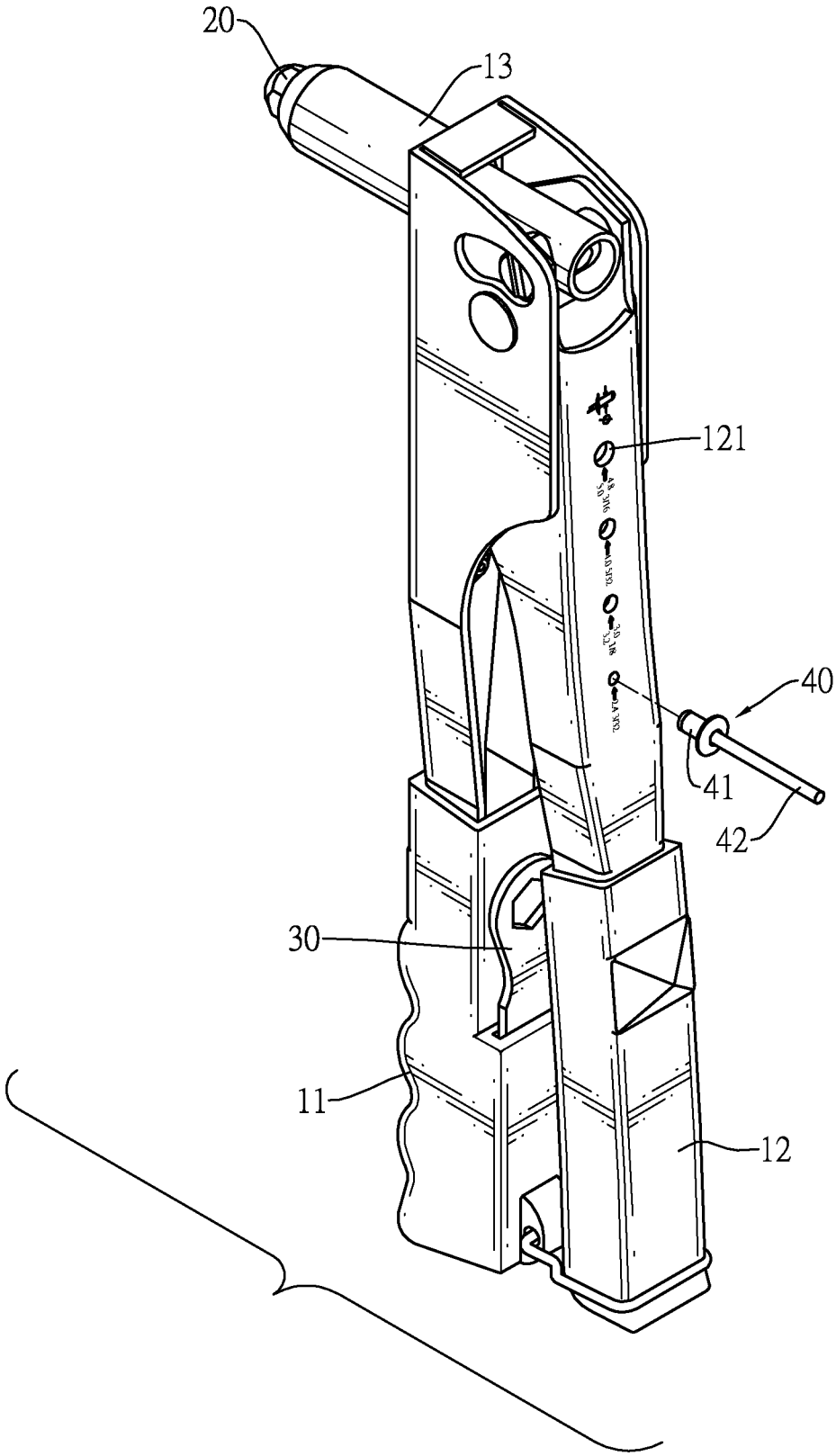
FIG. 6 is an operational prospective view showing a blind rivet failing to be inserted into a rivet body measuring hole on the actuation handle in FIG. 4.
Figure 7:
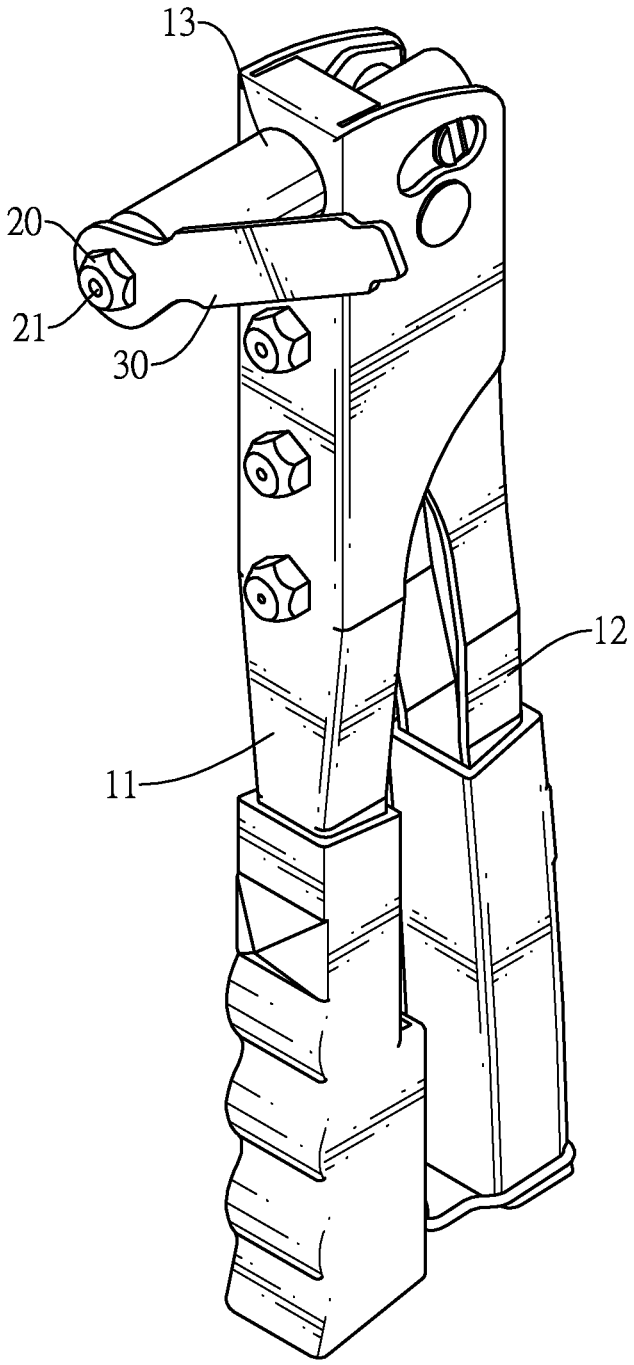
FIG. 7 is an operational prospective view showing a wrench to assemble or disassemble a nosepiece of the rivet tool in FIG. 1.

The actuation handle 12 has a first end and multiple rivet body measuring holes 121. The first end of the actuation handle 12 is pivotally mounted on the first end of the fixed handle 11. In the present embodiment, diameters of the rivet body measuring holes 121 are 3/32" (2.4 mm), 1/8" (3.0 or 3.2 mm), 5/32" (4.0 mm), and 3/16" (4.8 or 5.0 mm). With reference to FIG. 4, texts associated with specifications of rivet bodies and a drawing of rivet body are marked beside the corresponding rivet body measuring holes 121. With reference to FIGS. 5 to 7, blind rivets having a size of a rivet body being 3/16" (4.8 or 5.0 mm) can be smoothly inserted into the rivet body measuring holes 121 having diameters being 3/16" (4.8 mm or 5.0 mm), but fail to be smoothly inserted into the rivet body measuring holes 121 having diameters being 5/32" (4.0 mm), 1/8" (3.0 mm or 3.2 mm) and 3/32" (2.4 mm).

The pulling unit 13 can be movably connected to the first end of the actuation handle 12 and has a nosepiece fixing hole 111.

The nosepieces 20 are interchangeably mounted in the pulling unit 13 and the corresponding nosepiece fixing holes 111. Each of the nosepieces 20 has a mandrel through hole 21 having a matching diameter corresponding to the mandrel 42 of blind rivets 40.

The wrench 30 can be received in and removed from the storage slot of the fixed handle 11. Users can use the wrench 30 to assemble or disassemble the nosepieces 20 to select where they are mounted.

Figure 8:
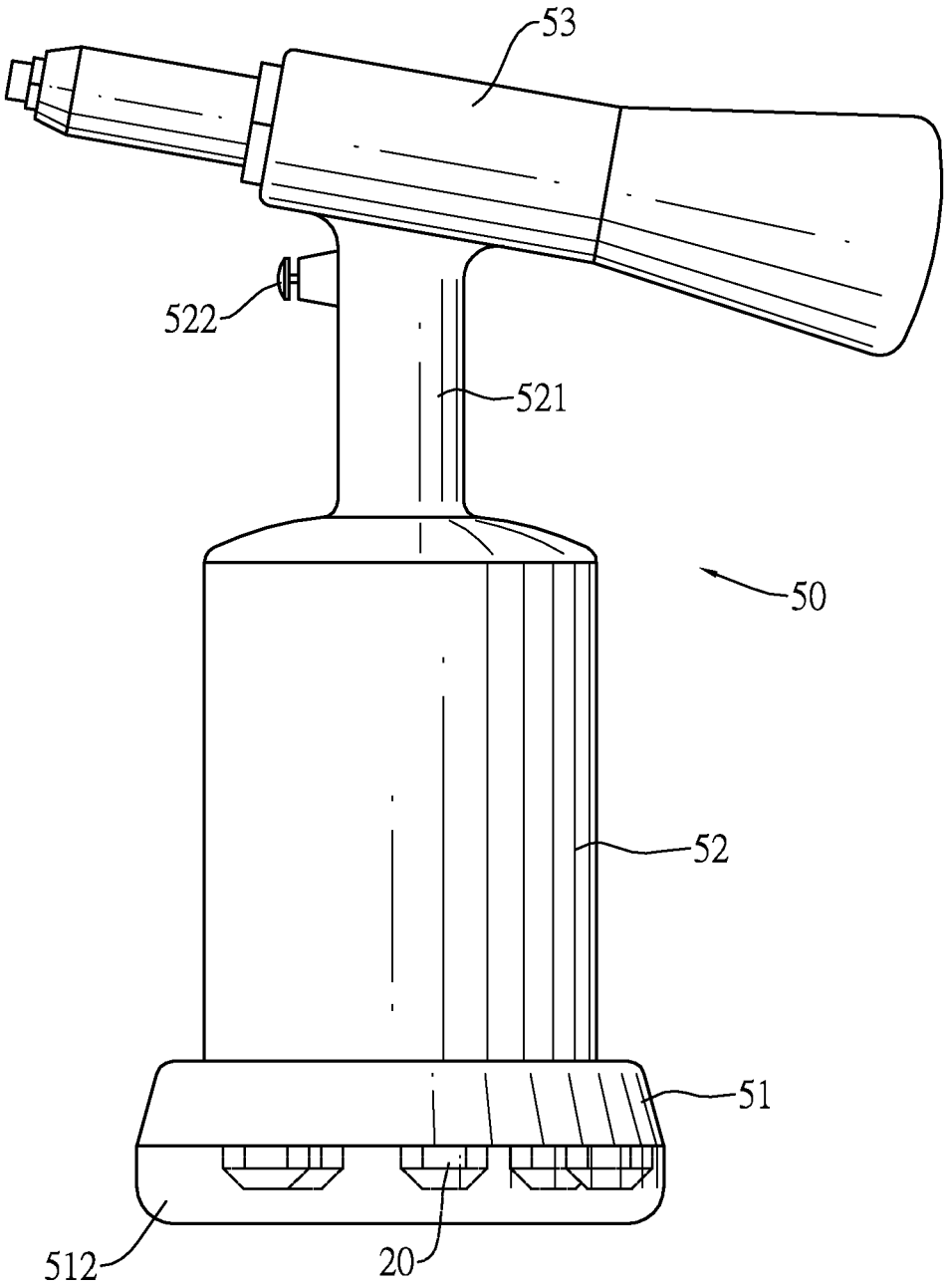
FIG. 8 is a side view of a second embodiment of a rivet tool capable of measuring size of blind rivet in accordance with the present invention.

Besides, with reference to FIG. 8, an air hydraulic rivet tool has a body 50 and multiple nosepieces 20.

Figure 9:
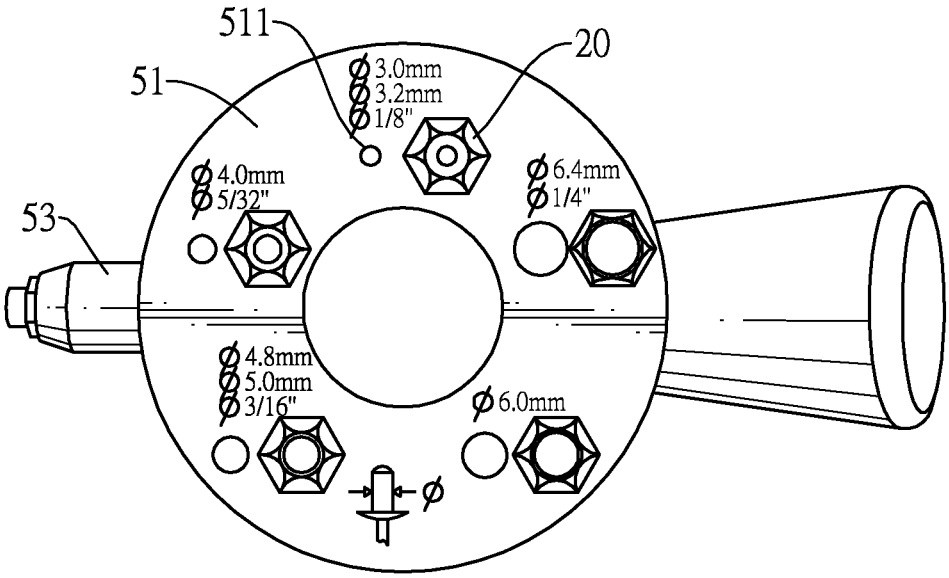
FIG. 9 is a bottom view of the rivet tool in FIG. 8.

The body 50 has a base 51, a pressure tank 52 and a hydraulic pulling unit 53. With reference to FIG. 9, the base 51 has multiple nosepiece fixing holes (not shown), multiple rivet body measuring holes 511 and a flange 512. The nosepiece fixing holes and the rivet body measuring holes 511 are formed through a bottom of the base 51. Texts associated with specifications of rivet bodies and a drawing of rivet body are marked beside the corresponding rivet body measuring holes 511. The flange 512 is formed on and protrudes downwardly from an edge of the bottom of the base 51. In the present embodiment, diameters of the rivet body measuring holes 511 formed through the bottom of the base 51 are 1/8" (3.0 or 3.2 mm), 5/32" (4.0 mm), 3/16" (4.8 mm or 5.0 mm), 6.0 mm and 1/4" (6.4 mm).

The pressure tank 52 is mounted on a top of the base 51 and has a connection portion 521 and an activation switch 522. The connection portion 521 is formed on and protrudes upwardly from a top of the pressure tank 52 and communicates with the pressure tank 52. The activation switch 522 is mounted on the connection portion 521.

The hydraulic pulling unit 53 is connected with the connection portion 521 and communicates with the pressure tank 52 through the connection portion 521.

The nosepieces 20 of the present embodiment have the same look as those of the hand-gripped rivet tool except that the nosepieces 20 can be mounted in the hydraulic pulling unit 53 and the nosepiece fixing holes on the bottom of the base 51. As shown in FIG. 8, the nosepieces stored in the bottom of the base 51 are surrounded and blocked by the flange 512 on the base 51.

Figure 10:
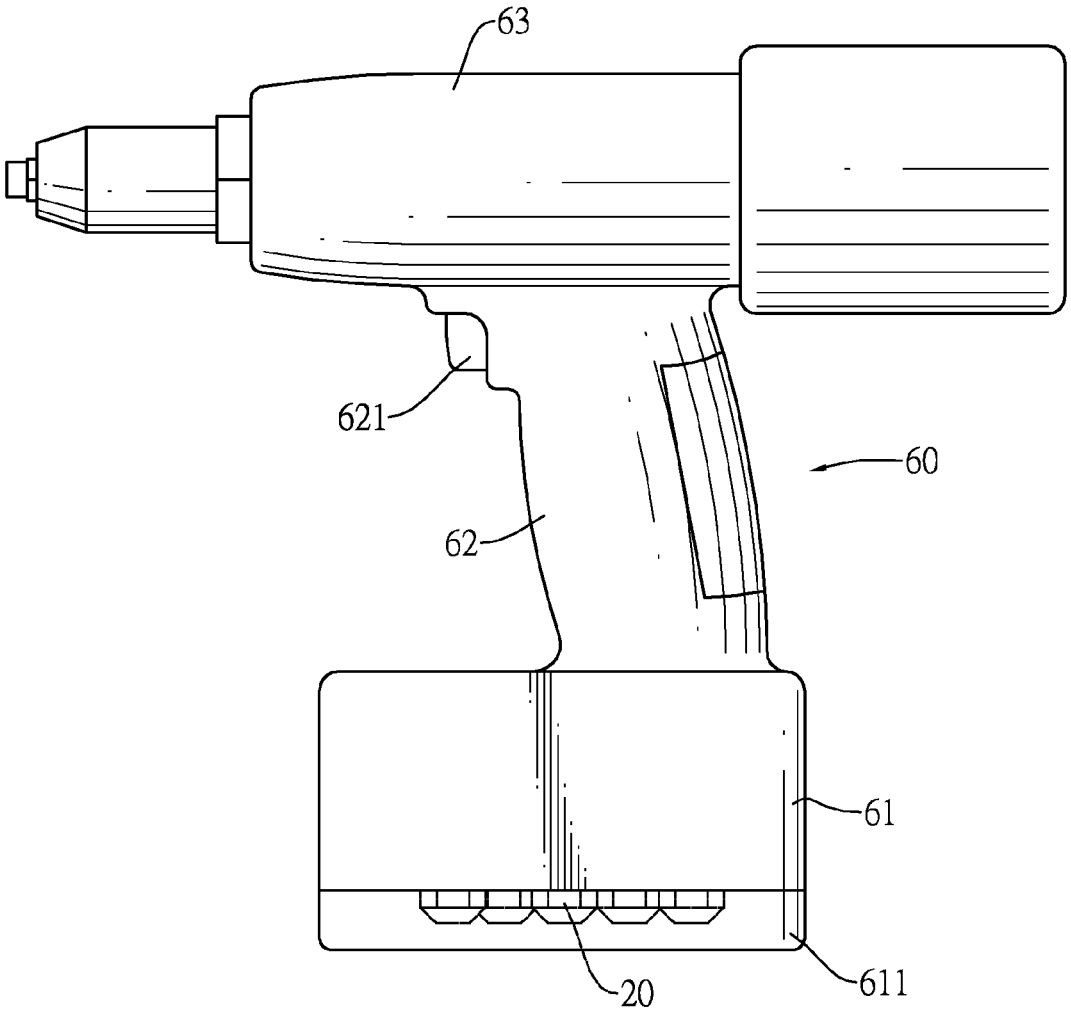
FIG. 10 is a side view of a third embodiment of a rivet tool capable of measuring size of blind rivet in accordance with the present invention.

With reference to FIG. 10, a rechargeable battery rivet tool has a body 60 and multiple nosepieces 20.

Figure 11:
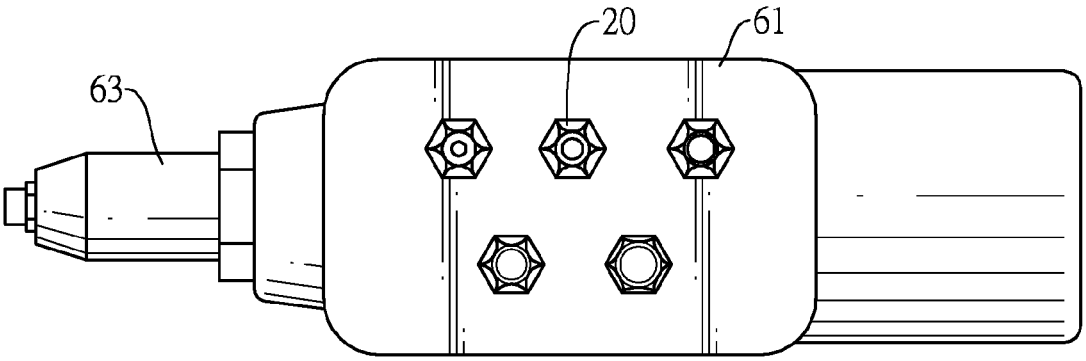
FIG. 11 is a bottom view of the rivet tool in FIG. 10.
Figure 12:
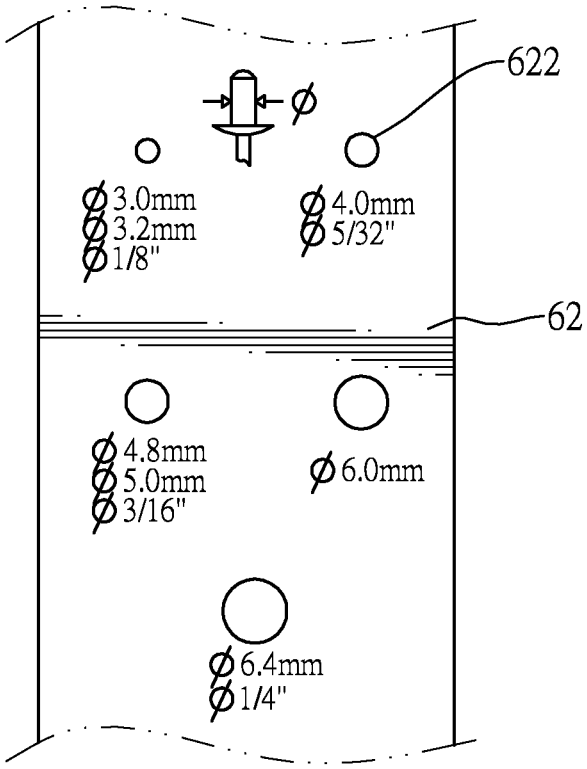
FIG. 12 is an another side view of the rivet tool in FIG. 10.

The body 60 has a battery base 61, a hand grip 62 and a mandrel pulling unit 63. With reference to FIG. 11, the battery base 61 has multiple nosepiece fixing holes (not shown) and a flange 611. The nosepiece fixing holes are formed through a bottom of the battery base 61. The flange 611 is formed on and protrudes downwardly from an edge of the bottom of the battery base 61. The hand grip 62 is formed erectly on a top of the battery base 61 and has an activation switch 621 and multiple rivet body measuring holes 622. The activation switch 621 is formed on the hand grip 62. With reference to FIG. 12, the rivet body measuring holes 622 are formed through one side of the hand grip 62. Texts associated with specifications of rivet bodies and a drawing of rivet body are marked beside the corresponding rivet body measuring holes 622. In the present embodiment, the hand grip 62 has multiple rivet body measuring holes 622 formed through the hand grip 62 and having diameters being 1/8" (3.0 or 3.2 mm), 5/32" (4.0 mm), 3/16" (4.8 mm or 5.0 mm), 6.0 mm and 1/4" (6.4 mm). The mandrel pulling unit 63 is connected with the hand grip 62 and is electrically connected with the activation switch 621.

The nosepieces 20 have the same look as those of the hand-gripped rivet tool except that the nosepieces 20 can be interchangeably mounted in the mandrel pulling unit 63 and the corresponding nosepiece fixing hole on the bottom of the battery base 61. As shown in FIG. 10, the nosepieces 20 stored in the bottom of the battery base 61 are surrounded and blocked by the flange 611 on the battery base 61.

Given the multiple rivet body measuring holes and the corresponding nosepieces, as long as users can directly insert a rivet body of a blind rivet into a matching rivet body measuring hole built in the rivet tool, a right nosepiece with corresponding size can be correctly selected for users to smoothly fasten the blind rivet with the rivet tool without wasting blind rivet or causing the rivet tool jammed by the broken mandrel.

Even though numerous characteristics and advantages of the present invention have been set forth in the foregoing description, together with details of the structure and function of the invention, the disclosure is illustrative only. Changes may be made in detail, especially in the matters of shape, size, and arrangement of parts within the principles of the invention to the full extent indicated by the broad general meaning of the terms in which the appended claims are expressed.

What is claimed is:

1. A rivet tool capable of measuring size of blind rivet, comprising:

a body having:

multiple rivet body measuring holes formed therein, each rivet body measuring hole having a diameter being different from those of other rivet body measuring holes and adapted to match a rivet body of a corresponding blind rivet by inserting the rivet body of the blind rivet into the rivet body measuring holes to match a corresponding rivet body measuring hole;

a text associated with a diameter of the rivet body of a matching blind rivet marked beside each rivet body measuring hole; and a drawing of rivet body of blind rivet with a diameter symbol marked beside the rivet body measuring holes for indicating that the rivet body measuring holes are adapted to measure and match the rivet bodies of the corresponding blind rivets; and multiple nosepieces interchangeably mounted on the body, each nosepiece having an insertion hole being different from those of other nosepieces in diameter and adapted to receive a rivet mandrel of a corresponding blind rivet with the rivet body matching a corresponding rivet body measuring hole.

2. The rivet tool as claimed in claim 1, wherein the body has:

a fixed handle having a first end;

an actuation handle having:

a first end pivotally connected with the first end of the fixed handle;

multiple rivet body measuring holes formed through an outer wall of the actuation handle; and the texts associated with the diameters of the rivet bodies of the corresponding blind rivets and the drawing of rivet body with the diameter symbol marked on the outer wall of the actuation handle; and a rivet mandrel pulling unit movably connected with the first end of the actuation handle.

3. The rivet tool as claimed in claim 2, wherein the fixed handle has multiple nosepiece fixing holes with a same internal thread size formed through an outer wall of the fixed handle, and the nosepieces are interchangeably mounted in the rivet mandrel pulling unit and the nosepiece fixing holes.

4. The rivet tool as claimed in claim 1, wherein the body further has:

a base having the rivet body measuring holes formed through a bottom of the base;

a pressure tank mounted on a top of the base and having:

a connection portion formed on and protruding upwardly from a top of the pressure tank; and an activation switch mounted on the connection portion; and a rivet mandrel hydraulic pulling unit connected with the connection portion and communicating with the pressure tank through the connection portion.

5. The rivet tool as claimed in claim 4, wherein the texts associated with specifications of rivet bodies and the drawing of rivet body of blind rivet with the diameter symbol are marked beside the corresponding rivet body measuring holes on the bottom of the base.

6. The rivet tool as claimed in claim 5, wherein a flange is formed on and protrudes from an edge on the bottom of the base;

multiple nosepiece fixing holes with a same internal thread size are formed through the bottom of the base and the nosepieces are interchangeably mounted in the rivet mandrel hydraulic pulling unit and the nosepiece fixing holes.

7. The rivet tool as claimed in claim 1, wherein the body further has:

a battery base;

a hand grip erectly formed on a top of the battery base and having:

an activation switch mounted thereon; and the multiple rivet body measuring holes formed through one side of the hand grip; and a rivet mandrel pulling unit connected with the hand grip and electrically connected with the activation switch.

8. The rivet tool as claimed in claim 7, wherein the texts associated with specifications of rivet bodies and the drawing of rivet body of blind rivet with the diameter symbol are marked beside the corresponding rivet body measuring holes on the side of the hand grip.

9. The rivet tool as claimed in claim 8, wherein the battery base has:

a flange formed on and protruding downwardly from a bottom of the battery base; and multiple nosepiece fixing holes with a same internal thread size formed through the bottom of the battery base for the nosepieces to be interchangeably mounted in the rivet mandrel pulling unit and the nosepiece fixing holes.

* * * * *